United States Patent [19]

Deike

[11] 3,969,854

[45] July 20, 1976

[54] PLANING FIN ANCHOR

[75] Inventor: Robert F. Deike, Cheyenne, Wyo.

[73] Assignee: Foresight Industries, Cheyenne, Wyo.

[22] Filed: Dec. 23, 1974

[21] Appl. No.: 535,428

[52] U.S. Cl. ..... 52/163; 52/166
[51] Int. Cl.[2] ..... E02D 5/80
[58] Field of Search ..... 52/166, 163

[56] References Cited

UNITED STATES PATENTS

| | | | |
|---|---|---|---|
| 855,298 | 5/1907 | Frost | 52/163 |
| 2,286,976 | 6/1942 | Roberts | 52/484 |
| 3,653,167 | 4/1972 | Merard | 52/166 |

*Primary Examiner*—Ernest R. Purser
*Assistant Examiner*—H. E. Raduazo

[57] ABSTRACT

A ground or earth anchor adapted to be driven lengthwise into the ground or placed lengthwise in a pre-dug hole in the ground and then is tilted or rotated into transverse or horizontal anchoring position by tension on a cable, rope, guy wire, rod or the like attached to the anchor. The anchor has an elongated rigid T-shaped body providing a web and two lateral flanges with a pointed leading end and down-turned sloping fins at the rear ends of the flanges causing the rear portion of the body to bite into the ground and tilt as the body is retracted. The outer or top edge of the web portion is provided with a hole to receive the cable or the like and this hole is positioned back of the longitudinal midpoint of the body so that the major area portions of the web and flanges will be ahead of the hole on the pointed end section of the body. The body is inserted lengthwise with its pointed end downwardly in the ground and has a length substantially greater than the diameter of a pre-dug hole receiving the body so that when tension is applied to the cable attached to the body, the sloping fins on the rear end will tilt or rotate the body into substantially horizontal position, while the pointed end of the body burrows or ploughs into the ground. The anchor is especially useful to secure guy wires and rods.

3 Claims, 9 Drawing Figures

PLANING FIN ANCHOR

BACKGROUND OF THE INVENTION

1. Field of the Invention

This invention relates to the art of earth or ground anchors and particularly to anchors which are inserted lengthwise into the ground and automatically rotated or tilted into locked relation under tension load.

2. Prior Art

In my U.S. Pat. No. 3,680,274 I have disclosed and claimed an anchoring device with screw vanes or fins radiating from a pile member having tentacles adapted to be projected into the ground for forming anchoring roots. This anchor is excellently adapted for heavy duty usage but may be too expensive for many installations where lesser anchoring capacity is sufficient.

SUMMARY OF THE INVENTION

According to the present invention, there is provided an inexpensive, small light weight ground anchor which rotates in the ground under tension loads into locking position. The anchor is attached to the end of a cable, rope, wire or rod and is driven lengthwise into the ground or dropped into a pre-dug hole in the ground to a desired level whereupon tension is applied to the cable or the like causing the anchor to tilt or rotate from an upright to a transverse position. The anchor body is preferably T-shaped in cross section providing a web and laterally extending flanges turned downwardly at one end to provide planing fins. The other end of the web and flanges are angled to provide a point so that when the anchor is rotated from an upright position to a transverse position it will burrow into the ground in the manner of a plough share. In order that the anchor will be tilted or rotated in the proper direction, the cable attachment is rearwardly from the center of mass so that in a free hanging position the pointed end of the anchor will tilt downwardly. The cable attachment is preferably through a hole near the outer or top edge of the web portion at a point rearwardly of the longitudinal mid-point of the anchor body. The anchor fits snugly in a pre-dug hole and of course the hole is filled above the anchor after tension on the cable rotates the anchor to its locking position.

It is then an object of this invention to provide an inexpensive, small and light weight ground anchor adapted to be driven lengthwise into the ground or dropped lengthwise into a pre-dug hole and then tilted under tension loads to a locked position.

Another object of the invention is to provide a ground anchor having an elongated rigid metal body with laterally extending flanges, a pointed leading end, and down turned fins on the trailing ends of the flanges together with a cable attachment positioned to rotate the anchor from an upright position under the ground to a transverse position which ploughs the pointed end into the ground.

A specific object of the invention is to provide an inexpensive light weight compact ground anchor of T-shaped cross-section with an upstanding central longitudinal web and laterally extending flanges and having a pointed leading end and planing fins on the trailing ends of the flanges.

Another specific object of the invention is to provide a ground anchor composed of a metal strip bent to form a U-shaped longitudinal web with out turned flanges on the ends of the legs of the U, with the web and flanges angle cut to provide a pointed leading end, with a hole through the web near the bight portion thereof and rearwardly from the longitudinal mid-point of the anchor, and with down turned fins on the trailing ends of the flanges.

Other and further objects of this invention will become apparent to those skilled in this art from the following detailed description of the preferred embodiment of the invention shown in the attached sheet of drawings.

DESCRIPTION OF THE PREFERRED EMBODIMENT

Figures 1, 2, 3, 4, 5, 6, 7, 8, 9:
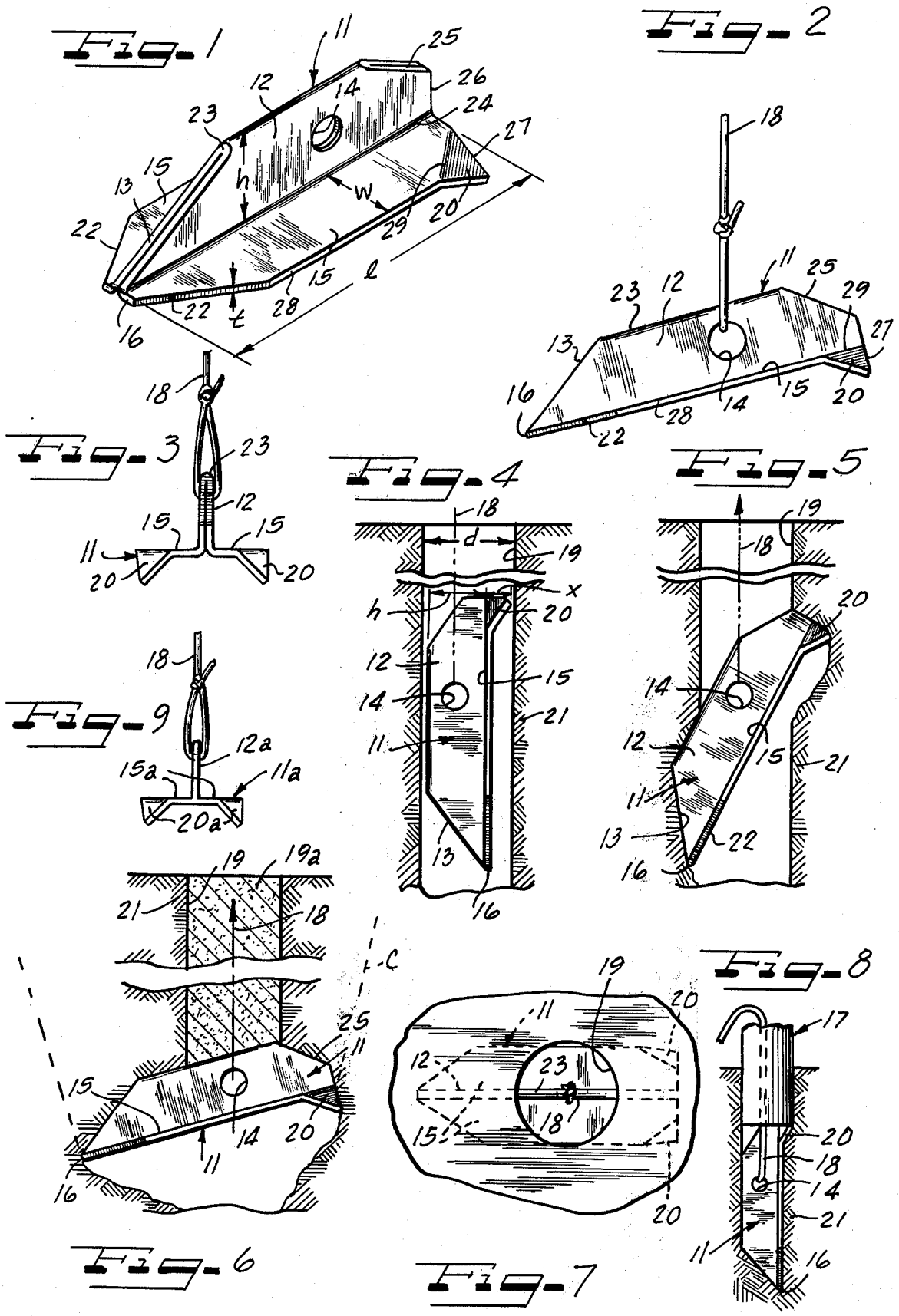
FIG. 1 is a perspective view of the planing fin anchor of this invention.
FIG. 2 is a side view of the planing fin anchor showing its free-hanging tilted equilibrium position.
FIG. 3 is a rear end view of the planing fin anchor positioned horizontally.
FIG. 4 illustrates the position of the planing fin anchor as it is lowered into a pre-drilled hole.
FIG. 5 illustrates the furrowing action of the planing fin anchor after partial retraction under tension in a pre-drilled hole.
FIG. 6 shows the equilibrium position of the planing fin anchor after full retraction.
FIG. 7 is a top view of FIG. 6 showing the planing fin anchor prior to filling the pre-drilled hole.
FIG. 8 shows the use of a hollow impact tool to drive the planing fin anchor into the ground.
FIG. 9 is an end view of the planing fin anchor constructed from a T-beam section.

The anchor 11 of this invention has a T-shaped cross section and may be constructed from sheet metal as shown in FIGS. 1 and 3 or formed from a forged or extruded T-beam section as shown in FIG. 9.

The anchor 11 as shown in FIGS. 1 to 3 is composed of sheet metal of a desired length 1 folded along this length to provide a U-shaped web 12 with a bight or top edge 23 and with flanges 15 bent outwardly from the ends of the legs of the web at 90° bends 24. The flanges have outer edges 28 and widths *w* between the web and outer edges.

In the T-beam modification of FIG. 9 the anchor **11*a* has integral single width web and flange portions 12*a* and 15*a* corresponding with the web and flanges 12 and 15 of the anchor 11**.

The rear ends of the flanges 15 and **15*a* have sloping planing fins 20 formed by bending downward flange corners 27 to form the fins at angles of about 30° to 45° relative to the flanges. Fold lines 29 between the flanges 15 and the planing fins 20 extend from the flange edges 28 to the rear end edges of the flanges outwardly from the bends 24** to provide flat flange portions between the web and planing fins.

The anchor 11 has a pointed leading end 16 formed by angle cutting the front end of the web 12 at 13 and the front ends of the flanges 15 at 22. These angle cuts may vary from, say, 45° to 30°. The pointed end 16 may extend to a sharp point or a chisel-like front edge.

The web 12 has a circular hole 14 cut therethrough near the outer edge 23 and rearwardly from the longitudinal mid point of the anchor so that the major portions of the flange areas will be forwardly of the hole. The diameter of the cable hole 14 is large enough to accept a heavy cable therethrough. A preferred embodiment includes positioning the hole 14 from the flanges 15 a distance of about three-quarters of the height *h* of the web while the diameter of the hole 14 may be from ¼ to ½ inch. The lengthwise positioning of the hole 14 is such that approximately 55% of the surface flange area is between the hole and the leading edge 16.

The rear end of the web 12 is angle cut at 25 from the edge 23 at an angle of about 45° to intersect the rear end 26 spaced from the bends 24.

The length of the anchor 11 will vary depending upon the magnitude of the load to be anchored. Typical anchor lengths will vary from 5 inches to 12 inches.

The anchor 11 is adapted to be driven into the ground 21 by hammering with an impact tool 17 or by dropping it into a pre-drilled hole 19 shown in FIGS. 4 and 5. The hole has a diameter *d* just slightly greater than the web height *h* and the height *x* of the planing fins 20 and of course greater than the combined widths *w* of the flanges 15 so as to snuggly receive the anchor in its upright or lengthwise position.

As shown in FIGS. 2 to 5, the cable 18 is anchored at its end in the hole 14 as by looping it through the hole and then tying the looped end in a knot or by any other attachment arrangement. When the anchor 11 is suspended from the cable, because of the rearward positioning of the hole 14, the pointed end of the anchor will tilt downwardly causing the anchor to assume an angle of about 15° from the horizontal.

When the anchor reaches a predetermined underground level in the hole 19 or by driving it into the ground to a desired depth, the cable 18 is pulled upwardly causing the planing fins 20 to be imbedded in the surrounding ground 21 and since the hole 14 is positioned near the outer edge 23 of the web 12 a cantilever action is created causing the planing fins 20 to dig into the soil. Since the cable hole 14 is also placed rearwardly of the mid point of the longitudinal length of the anchor with about 55% of the surface flange area toward the leading pointed end 16, further retraction of the cable will cause this leading end 16 to burrow into the ground 21 with a plough share action until attaining an equilibrium position which is about the same angle position assumed by the anchor when suspended freely from the cable as illustrated in FIG. 2. The ground trapped under the planing fins 20 and rear ends of the flanges 15 will be compacted downwardly to create the vaulting action causing the pointed end 16 to burrow into the ground.

The large planar areas of the flanges 15 presented to the ground in the transverse locking position of the anchor shown in FIG. 6 provides a diverging cone area of soil or earth designated by the dotted line c above the anchor which must be displaced before the anchor can be pulled out of the ground. It is intended that the locked position of the anchor in the ground will remain in the inclined position of FIG. 6 but if tension loads on the cable 18 are sufficiently great to further rotate the anchor to a horizontal position it will, of course, be appreciated that it still will remain imbedded in the ground until all of the earth or soil in an overlying zone c above the anchor is displaced.

The length *l*, height *h*, flange width *w* and thickness *t* of the flanges and web are correlated relative to the flowability of the soil or ground in which the anchor is to be imbedded. If the soil is dense and has great shear strength the dimensions can be minimized. Typical dimensions for an anchor with a length of 5 inches are web height *h* 1¼ inch, flange width *w* ¾ inch, sheet thickness *t* 1/12 inch, weight 7 ounces, planing fin height ¾ inch.

As shown in FIG. 8, the cable 18 may be threaded through a hollow impact tool 17 engaging the rear edge of the anchor 11 to drive the anchor into the ground to the desired depth. The impact tool may then be removed from the cable, the cable tensioned and the anchor rotated to the position of FIG. 6 in the ground 21.

When the hole 19 is pre-dug as illustrated in FIGS. 4 to 6 it is filled with earth 19*a* after the anchor is rotated to its locked position.

The term "cable" as used in the claims includes equivalents such as ropes, wires, rods and the like.

The anchors of this invention provide a small frontal area for ease in inserting the anchor lengthwise in the ground but have a large earth confronting planar surface area when rotated to locking position and the rotation is accomplished by upward pulling of a member to be anchored which is attached to the anchor body in laterally offset relation from the longitudinal axis of the body. This provides a cantilever between the fin end of the body and the member which tilts the body from an upright to a horizontal or transverse position.

It should be understood that the illustrated embodiments of the invention can be modified and varied without departing from the scope of the invention.

I claim as my invention:

1. A ground anchor for underground submergence comprising an elongated rigid member having a small frontal surface area with a pointed leading end for ease in inserting the member lengthwise in the ground, a large longitudinal planar surface area for restricting retraction from the ground having downturned fins on the trailing end and an upturned longitudinal central web, and a cable attached to the web sufficiently rearwardly of the longitudinal midpoint of the member to provide about 55% of the area of the member forwardly of the cable and in substantial laterally offset relation from the large longitudinal planar surface area thereof, said cable freely suspending the member in an inclined position with the pointed end below the level of the trailing end, and said cable being operable from above ground to pull the submerged member causing the pointed end to plough into the ground while the fins rotate the member from a lengthwise to an inclined transverse position with the pointed end below the level of the trailing end presenting the large planar surface thereof to the ground above the member and providing a large area of earth above the planar surface holding the member submerged in the ground to anchor tension applied to the cable.

2. A ground anchor adapted to be inserted lengthwise in the ground and rotated to a transverse anchoring position which comprises an elongated sheet metal member folded along its length forming a U-shaped web with a bight along the top edge thereof and with flanges bent outwardly at right angles from the ends of the legs of the web providing large planar surface areas, the rear end of said flanges being downturned to provide planing fin means, the leading ends of said flanges and web converging to the longitudinal axis of the member and forming a ground piercing leading end edge on the member, the rear end of said web having an inclined rear edge portion extending from the bight to the rear ends of the legs, said web having a hole therethrough substantially spaced from said flanges and adjacent said web and being positioned rearwardly on the longitudinal midpoint of the member to provide about 55% of the planar surfaces of the flanges forwardly of the hole, and a cable secured in said hole freely suspending said member in an inclined position with the leading end at a level below the trailing end whereby when the member is dropped into a hole in the ground of larger diameter than the combined height of the web and fin and greater than the combined widths of the flanges, and the cable is pulled from above ground level, the member will rotate from a vertical position toward the free state inclined position, with the leading end plowing into the ground and the fins on the trailing end planing into the ground along a path extending laterally of the hole to provide a large cone of earth above the member resisting retraction of the member from the hole.

3. A ground anchor adapted for dropping freely in an edge-wise position into a hole in the ground to be rotated to a transverse position resisting retraction from the hole which comprises an elongated metal T-shaped member having a longitudinal web and laterally extending flanges along the length of the web, said web and flanges having beveled leading edges converging to a piercing point at the longitudinal axis of the member, said flanges having downturned fin means on the trailing ends thereof, said web having a beveled rear edge sloping in the direction opposite to the direction of the front edge thereof, a hole in said web adjacent the lateral outer edge thereof and positioned rearwardly of the longitudinal midpoint of the member so as to provide about 55% of the planar surfaces of the flanges forwardly of the hole, a cable anchored in said hole freely suspending said member in an inclined position in the hole with the fin means riding along the wall of the hole, said cable suspending said member in a hole in the ground at a desired depth and being adapted to be pulled to cooperate with the side wall of the hole, to create a cantilever action on the member causing the pointed end of the member to plow into the ground and the fin end of the member to plane into the ground laterally of the wall of the hole in the ground to thereby embed the member in the ground and provide a large cone of earth resisting retraction of the member from the ground.

* * * * *